United States Patent [19]

Kaiser

[11] Patent Number: 4,502,393

[45] Date of Patent: Mar. 5, 1985

[54] WORKTABLE, PARTICULARLY AN OFFICE DESK

[75] Inventor: Josef Kaiser, Karben, Fed. Rep. of Germany

[73] Assignee: Konig & Neurath Kommanditgesellschaft, Fed. Rep. of Germany

[21] Appl. No.: 461,732

[22] Filed: Jan. 28, 1983

[30] Foreign Application Priority Data

Oct. 8, 1982 [DE] Fed. Rep. of Germany ..... 3237252

[51] Int. Cl.[3] ..... A47B 27/14; A47B 9/20

[52] U.S. Cl. ..... 108/1; 108/146; 248/408; 403/108

[58] Field of Search ..... 108/1, 144, 146; 312/231; 248/161, 371, 405, 406, 408; 403/106, 107, 108

[56] References Cited

U.S. PATENT DOCUMENTS

| | | | |
|---|---|---|---|
| 2,228,727 | 1/1941 | Pain, Jr. | 108/144 X |
| 2,376,716 | 5/1945 | Odin | 403/107 |
| 2,877,830 | 3/1959 | Smith | 248/371 X |
| 3,885,846 | 5/1975 | Chuang et al. | 108/146 X |
| 3,915,102 | 10/1975 | Barron | 108/144 |
| 4,374,497 | 2/1983 | Hammand | 248/421 X |

FOREIGN PATENT DOCUMENTS

| | | | |
|---|---|---|---|
| 107918 | 7/1943 | Sweden | 248/161 |
| 14325 | of 1884 | United Kingdom | 248/371 |

*Primary Examiner*—William E. Lyddane
*Assistant Examiner*—Peter R. Brown
*Attorney, Agent, or Firm*—Thomas W. Speckman

[57] ABSTRACT

A worktable, particularly an office desk, having a top adapted to be adjustable as to height and inclination. The top is supported on four vertically adjustable columns, each of the two columns of the pair of columns in front and the two columns of the pair of columns in the rear are jointly adjustable in guides provided in the trestle. To selectively adjust the height and inclination of the table top, latch receptacles are provided on all columns spaced along their length to receive compression spring urged locking pins installed in the trestle. Each of the pair of support columns is associated with a lever mechanism by means of which each pair of support columns can be rotated, the latch connection unlatched and, upon adjustment of the pair of columns, the latched position re-established.

16 Claims, 5 Drawing Figures

WORKTABLE, PARTICULARLY AN OFFICE DESK

BACKGROUND OF THE INVENTION

This invention relates to a worktable, particularly an office desk, having a table top which is adjustable as to height and angle of inclination. The table top is supported on four vertically adjustable columns. The two columns of the pair of front columns and the pair of back columns are commonly adjustable in guide means installed in the table frame.

A worktable of this general type has been disclosed in German Patent DE-PS No. 64 229. In the table of this patent, the support columns are in the form of threaded shafts operated by a crank which is normally in operative engagement with all threaded shafts by means of gears. If the table top is not to be raised or lowered equally in the front and rear, the drive mechanism may be disconnected from the pair of columns in the front so that the drive action is exerted only on the pair of columns in the rear and the table top can be raised or lowered in the rear only.

In a worktable disclosed in German Patent DE-PS No. 28 46 223, the columns and their guides are in the form of threaded shaft-running nut combinations and are operated by electric motors. Each of the front and rear threaded shaft-running nut mechanisms is provided with an electric drive motor of its own, and the drive motors are coupled in an electric circuit by two push buttons in a manner such that actuating the first of the two push buttons causes the table top to be raised and actuating the second push button causes the table top to be lowered. A simultaneous actuation of both of the push buttons effects a raising of the table top in back and at the same time a lowering in front. The drive mechanism for this worktable is of considerable complexity and a change in inclination of the table top, for example, an adjustment toward a smaller angle of inclination, requires the table top to be moved first into the lower or upper end position of a pair of columns before it can subsequently be raised or lowered.

SUMMARY OF THE INVENTION

It is the object of the present invention to provide a worktable or desk of the aforementioned type wherein the table top is adjustable as to height and inclination in a simple manner and with a minimum of adjustment and drive means.

This is accomplished according to the invention by providing the support columns with latch receptacles spaced on one side along their longitudinal direction for receiving latching pins disposed in the table base frame and resiliently maintained by compression springs, and further, by providing a lever bar for each pair of columns to enable them to be rotated, to unlatch the latching connection and, upon counter rotation of the pair of columns, to re-establish the latching connection.

By operating the appropriate lever bar, the column pairs may be moved into latching positions independently of each other and may be unlatched or moved out of the latching positions. The table top is adjusted manually while the column pairs are unlatched, affording a one-hand operation, while the other hand is available for manipulating the appropriate lever bar.

The locking or latch connections between the pairs of columns and the locking or latching pins installed in the trestle are achieved according to one embodiment in that the free end of the latching pins are truncated, and that the latch receptacles are in the form of blind bore type recesses having conically widening inlet openings.

Another embodiment of the latch connections provides for the latching pins to terminate in a truncated cone shape, that the latch receptacles take the form of semicircular circumferential notches in the support columns, and that the circumferential notches are separated from each other by solid circumferential wall sections of the column.

The vertical adjustment of the columns is facilitated in the simplest conceivable manner in that the columns are slidably adjustable in guides which are integrally formed with or installed in the plate-shaped base portions forming the legs of the trestle or table frame.

In one embodiment of the lever mechanism serving to impart a turning motion to the columns of a pair of columns, each column has attached to its upper end portion, facing the table top, a pivot lever. These pivot levers on each pair of columns are pivotally connected by means of a control lever and each control lever has an actuating lever pivoted thereto. The actuating lever is rotatably attached to the underside of the table top by means of a bearing pin.

According to another embodiment, in the latched condition of the support columns, the supporting surfaces attached to the top ends of the columns are directed parallel to each other and project toward the front of the table top, and the actuating levers extend in a spaced parallel relationship toward the front of the table top at which end they are provided with handles so that the latching may be unlatched by moving the actuating levers in one or the other direction of rotation, and the latched or locked condition may be re-established by moving the actuating levers back into their initial position.

In order for the latching mechanisms to be installed in the plate-shaped base portion forming the legs of the trestle, another embodiment provides that in the latched positions of the support columns, the latch receptacles are directed toward the front of the table top for receiving the latching pins projecting toward the back of the table top.

To effect an adjustment between the support columns and the lever mechanism, one embodiment provides that each support surface on the columns has an eyelet or grommet which is secured against rotation by a set-screw tightening against the support column.

The pivotable support and mounting of the table top is achieved according to one embodiment, in that the support columns at their upper ends terminate in a bearing ball which is inserted in a hemispherical cup provided on the underside of the table top and the ball is retained therein by means of a retainer plate.

The attachment of the retainer plate is facilitated by dividing the plate in the region of the passageway for the column. This passageway is conically enlarged away from the bearing ball. The conical enlargement permits the necessary pivotal movement of the table top.

The installation of the latching pins along with the compression springs in the trestle is facilitated according to another embodiment, in that the latching pin and the compression spring are inserted into a semicircular blind bore receptacle provided in the trestle, and are retained therein by a cover plate having a complementary semicircular blind recess.

BRIEF DESCRIPTION OF THE DRAWING

The invention will be described in further detail with reference to a representative embodiment illustrated in the drawings wherein.

DESCRIPTION OF PREFERRED EMBODIMENTS

Figure 1:
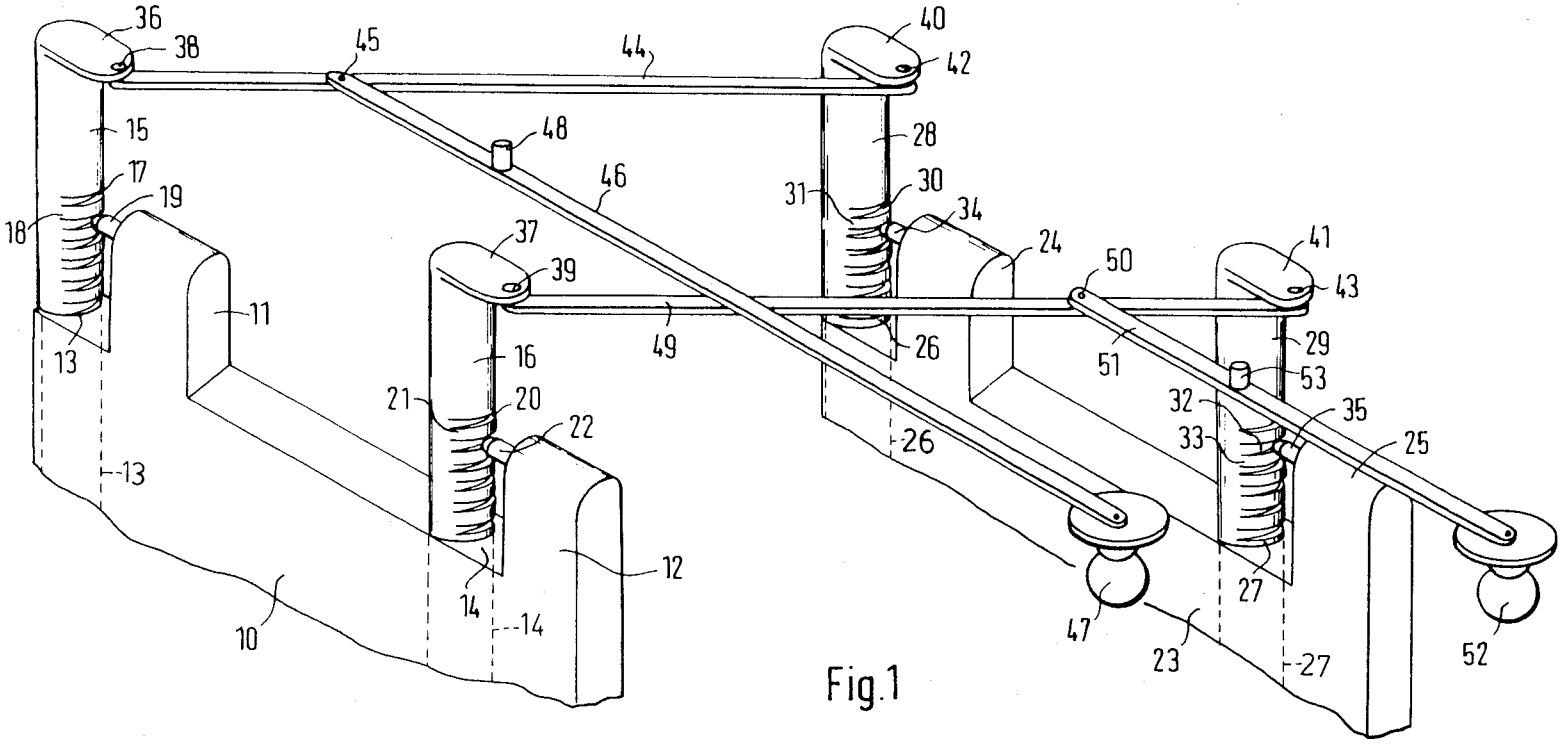
FIG. 1 is a schematic perspective view of four support columns without a table top but with two lever bars, latching pins and latch receptacles.
Figure 2:
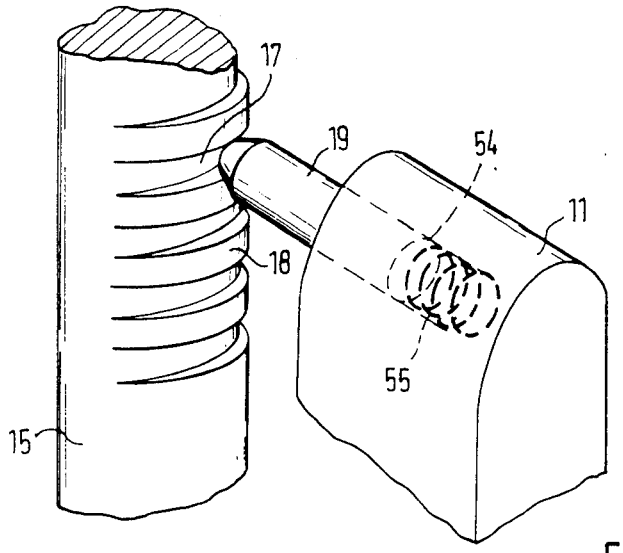
FIG. 2 is a perspective partial view of a support column locked in place by a locking pin.

Referring to FIG. 1, the worktable or desk is shown without a top having two plate-shaped base portions or legs 10 and 23 of the table frame or trestle. Projecting upwardly from the top edges of the legs 10 and 23 are extensions 11, 12 and 24, 25, respectively, having installed therein the locking or latching pins 19, 22 and 34, 35, respectively. As is shown in the partial views of FIGS. 2 and 3, locking pin 19 is resiliently installed in blind bore 54 by means of compression spring 55 and with its free end engages support column 15.

As is shown in FIG. 1, horizontal locking pins 19, 22 and 34, 35 are directed from the front toward the back of the worktable, the top of which is not shown in the figure. Support columns 15, 16, 28 and 29 are guided in cylindrical guides 13, 14, 26 and 27 and are provided with latch receptacles 17, 20, 30 and 32 spaced along their vertical length. The latch receptacles in the illustrated embodiment of FIGS. 1, 2 and 3 have the shape of semicircular circumferential notches or recesses separated from each other by circumferential bandshaped wall sections 18, 21, 31 and 33. The latch receptacles 17 may also be in the form of blind bore recesses having conically widening inlet openings. In the latched position shown in FIG. 1, all of the latch receptacles 17, 20, 30 and 32 of support columns 15, 16, 28 and 29 are facing the front of the table top and are in operative engagement with the locking pins 19, 22, 34 and 35, depending upon height or angular adjustment. Thus, the table top is locked in the position of desired adjusted height and degree of inclination.

Figure 3:
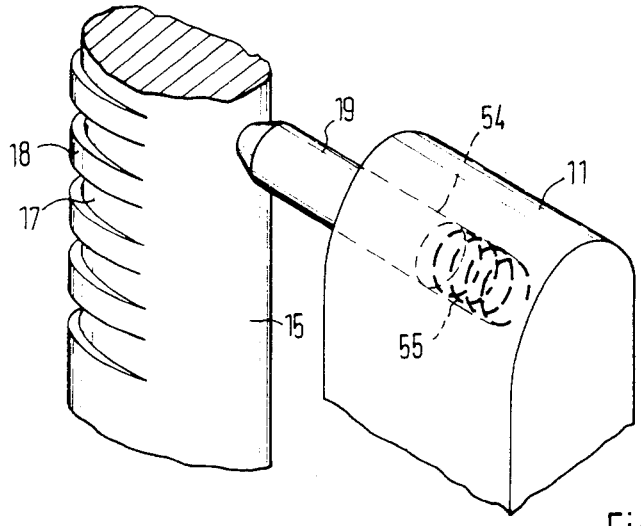
FIG. 3 is a perspective partial view showing a support column turned and disconnected from a locking pin.
Figure 2A:
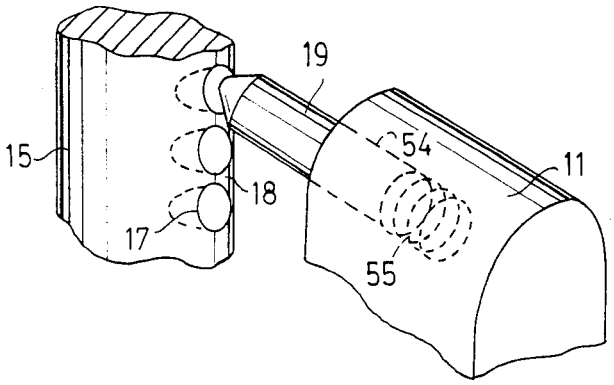
FIG. 2A is a perspective partial view of a support column locked in place according to another embodiment.
Figure 4:
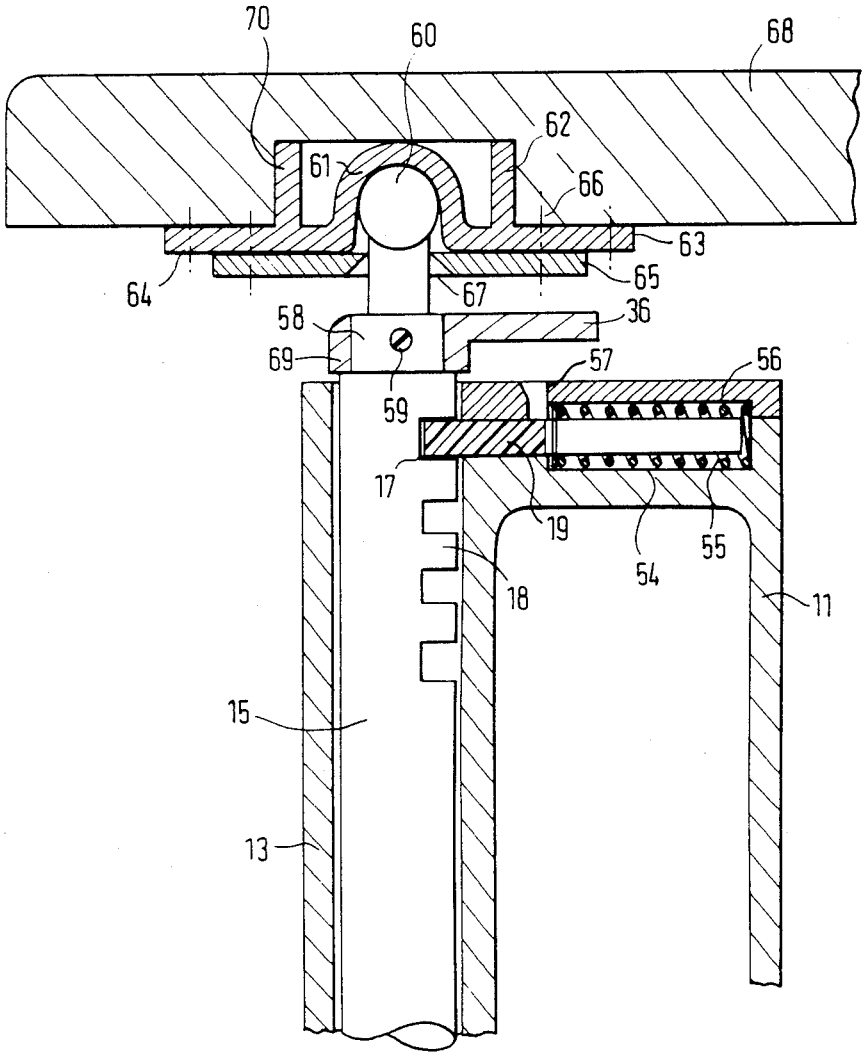
FIG. 4 is a partial sectional view showing the pivotal mounting of a table top on a support column.

Attached to the upper ends of columns 15, 16, 28 and 29 are pivot levers 36, 37, 40 and 41. As shown in FIG. 4, the pivot lever is attached to section 48 of column 15 by means of eyelet grommet 69 and secured against rotation by setscrew 59. Columns 15 and 28 toward the rear of the table are movably connected by control lever 44 attached by pivot pins 38 and 42. Near column 15, actuating lever 46 is pivotally connected to control lever 44, as is shown by pivot pin 45. Actuating lever 46 is rotatably attached to the underside of the desk top by means of bearing pin 48. Attached to the free end of actuating lever 46 is a handle in the shape of knob 47. In the locked position, actuating lever 46 is positioned perpendicular to control lever 44. Moving lever 46 in one or the other direction causes control lever 44 to turn columns 15 and 28 in the opposite direction, whereby locking pins 19 and 34 slide out of notches 17 and 30 in columns 15 and 28, as is shown in FIG. 3. Locking pin 19 rests with its truncated end portion against column 15 which is now free to be vertically adjusted. The desk or table top then may be taken hold of at its rear edge and raised or lowered. When the desired position is reached, actuating lever 46 is moved back to its initial position, causing locking pins 19 and 34 to again enter into latch receptacles 17 and 30 in columns 15 and 28. Thus, the back columns are locked in their newly adjusted positions.

Similarly, the two front columns 16 and 29 are pivotally connected by control lever 49, as is shown by pivot pins 39 and 43 provided in pivot levers 37 and 41. Close to column 29, actuating lever 51 is joined to control lever 49 by means of pivot pin 50, and is rotatably attached to the underside of the table top by means of bearing pin 53. Attached to the free end of actuating lever 51 is handles 52. In the locking position, actuating lever 51 is perpendicular to control lever 49 and spaced parallel from actuating lever 46. Handles 47 and 52 are accessible from the front of the desk or table top. Actuating lever 51 enables the latching of columns 16 and 29 of front pair of columns to be unlocked and again relocked. Actuating lever 51 may be moved out of the illustrated initial position and back into it and the front of the table top can be adjusted to a different position between these two pivotal movements of actuating lever 51.

As shown in FIG. 4, column 15 is guided in cylindrical guide 13 which is part of leg 10. Projection 11 is provided with a semicircular blind bore 54 for receiving locking pin 19 and compression spring 55. Cover plate 56 completes receptacle 54 for holding locking pin 19 and compression spring 55 and is attached to projection 11 by screw at 57. This division of the blind bore 54 receptacle facilitates the installation of locking pin 19 and compression spring 55 in the trestle.

The upper end of the columns is formed by a bearing ball 60 disposed in a hemispherical cup 61. The hemispherical cup 61 is installed with a sleeve-shaped extension 62 into blind bore 70 in the underside of table top 68 and is fastened to the underside of the table top by plate 63 secured by screw connection at 64. Bearing ball 60 is retained in hemispherical cup 61 by means of a retaining plate 65. Retaining plate 65 is divided in the area of the passageway 67 for the end portion of the column. This facilitates the attachment of retaining plate 65 to the hemispherical cup 61 by screws at 66. Passageway 67 also contributes to retention of bearing ball 60 in hemispherical cup 61 and is conically enlarged on the side away from bearing ball 60 to enable the table or desk top 68 to achieve the desired pivotal movement about support column 15.

I claim:

1. Worktable having a table top which is adjustable as to height and angle of inclination and a base, said table top being supported on four vertically adjustable support columns in said base, two columns forming a pair of front columns (16, 29) and two columns forming a pair of rear columns (15, 28), each pair of columns being adapted to be jointly rotatably and vertically adjustable in guide means in said table frame, characterized in that all of said support columns (15, 16, 28, 29) are provided with pivot means rigidly attached to the upper ends thereof and having latch receptacles (17, 20, 30, 32) spaced on one side along their longitudinal direction for receiving in a latched position locking pins (19, 22, 34, 35) disposed in said table frame and resiliently urged against said columns by compression springs (55), and that a control lever (44) is connected to the pivot means of said pair of rear columns (15, 28) and a control lever (49) is connected to the pivot means of said pair of front columns (16, 29) to enable each pair of columns (15, 28 and 16, 29) to be turned, to disengage said latch receptacles from said locking pins and, upon adjustment of each pair of columns, to re-establish the latched position.

2. Worktable according to claim 1, characterized in that said locking pins (19, 22, 34, 35) are truncated, and that said latch receptacles are in the form of blind holes having conically widening inlet openings.

3. Worktable according to claim 1, characterized in that said locking pins (19, 22, 34, 35) terminate in a truncated cone shaped portion, that said latch receptacles (17, 20, 30, 32) are in the form of semicircular circumferential notches in said support columns (15, 16, 28, 29), and that said circumferential notches are separated from each other by circumferential sections (18, 21, 31, 33) of the wall surface of said columns.

4. Worktable according to claim 3, characterized in that said columns (15, 16, 28, 29) are slidably adjustable in guides (13, 14, 26, 27) in base portions forming legs (10, 23) of the trestle.

5. Worktable according to claim 4, characterized in that said pivot means includes each said column having attached to its upper end portion a pivot lever (36, 40, 37, 41) facing said table top (68), said pivot levers (36, 40 and 37, 41) on said pairs of columns (15, 28 and 16, 29), respectively, being pivotally linked by a respective said control lever (44, 49), and that each control lever (44, 49) has an actuating lever (46, 51), respectively, pivotally linked thereto and rotatably attached to the underside of the table top (68) by means of a bearing pin (48, 53), respectively.

6. Worktable according to claim 5, characterized in that in the latched condition of said support columns (15, 16, 28, 29), said pivot levers (36, 37, 40, 41) mounted on the upper ends of said support columns (15, 16, 28, 29), respectively, are parallel to each other and project toward the front of said table top (68), and that said actuating levers (46, 51) extend in a spaced parallel relationship toward the front of said table top (68) at which end they are provided with handles (47, 52), respectively.

7. Worktable according to claim 6, characterized in that in the latched position of said support columns (15, 16, 28, 29), said latch receptacles (17, 20, 30, 32) face the front of said table top (68) to receive said locking pins (19, 22, 34, 35), respectively, projecting toward the back of said table top (68).

8. Worktable according to claim 5, characterized in that each pivot lever (36, 47, 40, 41) has an eyelet grommet (69) which is secured against rotation on a section (58) of said support column by a setscrew (59).

9. Worktable according to claim 8, characterized in that each said support column at its upper end terminates in a bearing ball (60) adapted for insertion in a hemispherical cup (61) provided on the underside of said table top (68) and which is retained therein by a retainer plate (65).

10. Worktable according to claim 9, characterized in that said retainer plate (65) is divided in the region of a passageway (67) for said column and said passageway (67) is conically enlarged on the face away from said bearing ball (60).

11. Worktable according to claim 10, characterized in that said locking pin and said compression spring (55) are inserted into a semicircular blind bore receptacle (54) in said base, and are retained therein by a cover plate (56) forming a complementary semicircular blind bore receptacle.

12. Worktable according to claim 1, characterized in that said columns (15, 16, 28, 29) are slidably adjustable in guides (13, 14, 26, 27) in base portions forming legs (10, 23) of the trestle.

13. Worktable according to claim 1, characterized in that said pivot means includes each said column having attached to its upper end portion a pivot lever (36, 40, 37, 41) facing said table top (68), said pivot levers (36, 40 and 37, 41) on said pairs of columns (15, 28 and 16, 29), respectively, being pivotally linked by respective a said control lever (44, 49), and that each control lever (44, 49) has an actuating lever (46, 51), respectively, pivotally linked thereto and rotatably attached to the underside of the table top (68) by means of a bearing pin (48, 53), respectively.

14. Worktable according to claim 1, characterized in that the latched position of said support colums (15, 16, 28, 29), said latch receptacles (17, 20, 30, 32) face the front of said table top (68) to receive said locking pins (19, 22, 34, 35), respectively, projecting toward the back of said table top (68).

15. Worktable according to claim 1, characterized in that each said support column at its upper end terminates in a bearing ball (60) adapted for insertion in a hemispherical cup (61) provided on the underside of said table top (68) and which is retained therein by a retainer plate (65).

16. Worktable according to claim 1, characterized in that said locking pin and said compression spring (55) are inserted into a semicircular blind bore receptacle (54) in said base, and are retained therein by a cover plate (56) forming a complementary semicircular blind bore receptacle.

* * * * *